United States Patent [19]

Douglas

[11] 4,377,009

[45] Mar. 22, 1983

[54] HEAD PROTECTOR

[76] Inventor: Huey Douglas, 1024 Flora La., Baton Rouge, La. 70810

[21] Appl. No.: 331,591

[22] Filed: Dec. 17, 1981

Related U.S. Application Data

[62] Division of Ser. No. 76,074, Sep. 17, 1979, Pat. No. 4,322,858.

[51] Int. Cl.[3] ..... A42B 1/08

[52] U.S. Cl. ..... 2/411; 2/9; 2/416; 2/425

[58] Field of Search ..... 2/9, 411, 410, 416, 2/425, 2, 51

[56] References Cited

U.S. PATENT DOCUMENTS

| | | | |
|---|---|---|---|
| 921,352 | 5/1909 | Blaker et al. | 2/28 X |
| 2,297,874 | 10/1942 | Clark | 2/425 X |
| 3,686,689 | 8/1972 | Berlinski et al. | 2/2 |
| 3,866,909 | 2/1975 | DeSantis | 2/411 X |
| 4,223,409 | 9/1980 | Lee | 2/411 |

FOREIGN PATENT DOCUMENTS

| | | | |
|---|---|---|---|
| 1020284 | 12/1957 | Fed. Rep. of Germany | 2/51 |
| 2614892 | 10/1977 | Fed. Rep. of Germany | 2/411 |

*Primary Examiner*—H. Hampton Hunter

*Attorney, Agent, or Firm*—Roy, Kiesel, Patterson & McKay

[57] ABSTRACT

Garments for the protection of a football player's jaws are disclosed utilizing lightweight overlapping flexible jointed flap members attached together by cloth padding to cover the player's jaws and other parts of the face.

4 Claims, 8 Drawing Figures

HEAD PROTECTOR

RELATED APPLICATIONS

This is a divisional application of United States patent application Ser. No. 76,074 filed Sept. 17, 1979 by the inventor herein, now U.S. Pat. No. 4,322,858, dated Apr. 6, 1982, and entitled "Protective Garments for Football Players," specific mention of which is made for the purpose of obtaining benefit of its earlier filing date.

BACKGROUND OF THE INVENTION

1. Field of the Invention

This invention relates broadly to wearing apparel and, more particularly, to protective head gear to protect football players from injuries resulting from blows to the head.

2. Prior Art

In violent contact sports, such as football, the players are constantly subjected to blows that result in broken or cracked bones. In particular, the player's rib cage and jaw area have been areas of frequent injury.

To reduce these injuries, numerous types of padding, helmets and even flack jackets have been employed. However, the need for flexible, lightweight garments that do not restrict the player's movements but which afford more reliable, better protection against broken or cracked bones, particularly to the rib cage and jaw, are still desired.

SUMMARY OF THE INVENTION

Therefore, it is an object of this invention to provide garments to be worn by football players which reduce the possibility of injury to the player's body.

Another object of this invention is to provide a head or jaw protector garment designed to be worn by a football player.

Other objects and advantages of this invention will become apparent from the ensuing descriptions of the invention.

A head or jaw protective gear is provided comprising a soft, flexible head piece shaped to fit over the top of a person's head and extending down each side of the head to cover the back portion of the jaw bones, a chin strap attached to the head piece to cause the head piece to fit snugly against the person's head, and flap assemblies having overlapping, flexible flaps attached to said head piece and shaped to cover the back portion of the jaw bone.

PREFERRED EMBODIMENTS OF THE INVENTION

Figure 1:
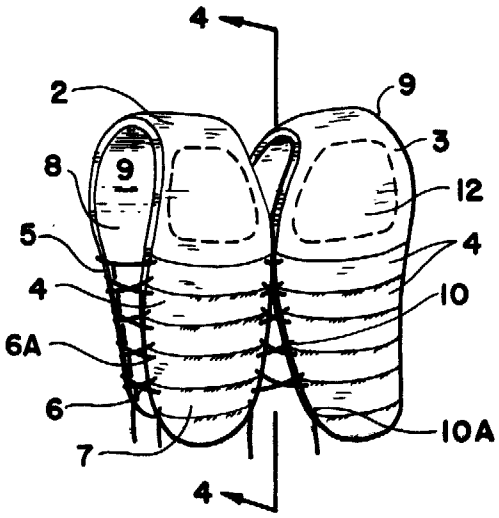
FIG. 1 is a three dimensional frontal view of one preferred embodiment of the rib cage design of this invention.

As seen in FIGS. 1-5, a protective rib cage garment, denoted generally by the numeral 1, comprises liner cloth pieces 2 and 3 that each form a front section 4 and back section 5. Each piece 2 and 3 are connected on one side by laced strings 6 passing through eyelets 6A that extend from the bottom area 7 of each section 4 and 5 upward to a point 8 that leaves a sufficient opening 9 through which an arm can extend. Pieces 2 and 3 are connected in the front by a second laced string 10 passing through eyelets 10A. In the back, pieces 2 and 3 are connected together by stitching. In this manner, a vest shaped liner is formed.

Attached to the front and back sections 4 and 5 are overlapping flexible plastic or rubber flaps 11 that extend over the wearer's rib cage. Each flap 11 preferably comprises a relatively thin, convex shaped shock absorbing member 11A to which is attached, along the top portion of member 11A, a cloth piece 11B. This cloth piece 11B preferably extends across the entire top length of member 11A and then is bent back around so that it can be sewn to liner cloth pieces 2 or 3. In this manner, flap member 11A is hingedly connected and, thus, will move somewhat when being struck. Also, since it is preferred that member 11A be constructed of material having flexibility, it too will flatten somewhat out when being struck; thus, absorbing some of the force. Since flap members 11A are overlapped, their end 11C will rest on surface 11D of the adjacent lower flap member, which results in an even more resilient structure design, particularly when surface 11D is smooth.

In another preferred embodiment, rubber or cloth padding 12 is attached in conventional manner above flaps 11 to protect the chest and upper back and shoulder blade areas of the body. It is also noted that flaps 11 could also be secured to front and back sections by placing them in cloth pockets attached to the sections in a manner similar to that used for padding.

Figure 2:
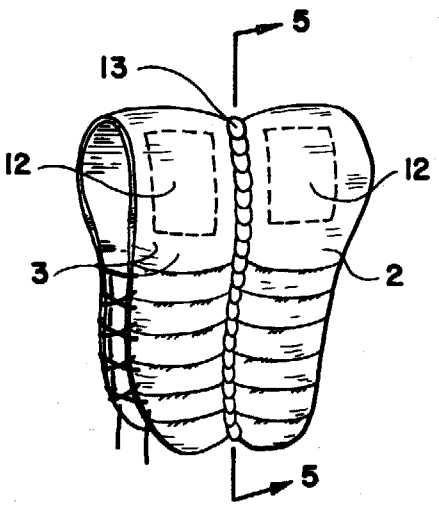
FIG. 2 is a three dimensional rear view of one preferred embodiment of the rib cage design of this invention.
Figure 3:
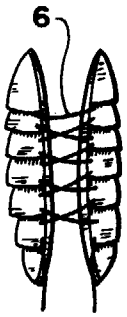
FIG. 3 is a three dimensional side view of one preferred embodiment of the rib cage design of this invention.
Figure 4:
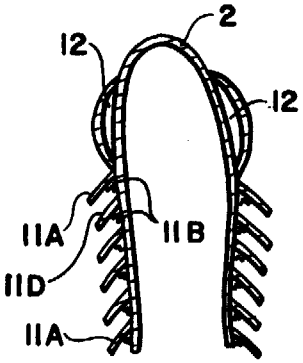
FIG. 4 is a cross-sectional view taken along lines 4—4 of FIG. 1.
Figure 5:
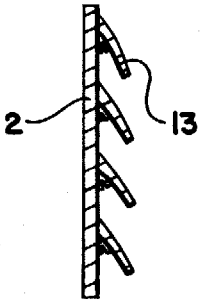
FIG. 5 is a cross-sectional view taken along lines 5—5 of FIG. 2.

In still another preferred embodiment, spinal column flaps 13 are provided to prevent damage to the spinal column when the player is struck from the rear. These flaps are similar in construction to flaps 11, but are shaped to fit only over the spinal cord area as seen in FIG. 2. They are attached by sewing to liner cloth pieces 2 and 3.

Figure 7:
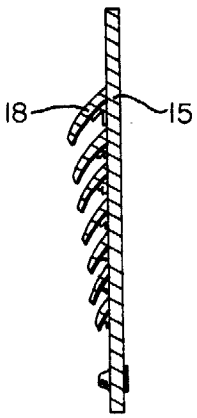
FIG. 7 is a cross-sectional view taken along lines 7—7 of FIG. 6.
Figure 6:
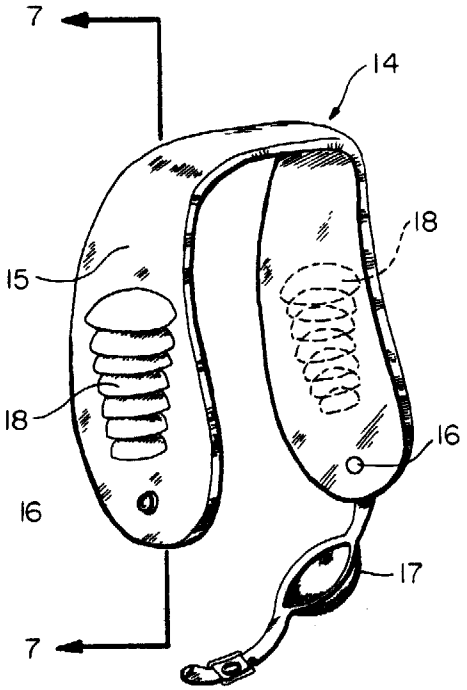
FIG. 6 is a three dimensional view of a preferred embodiment of the jaw protector of this invention.

As seen in FIGS. 6 and 7, a jaw protective garment, denoted generally by the numeral 14, is provided comprising a cloth strap piece 15 that fits over the top of a player's head and extends down each side of his face covering the back part of the player's jaw. At the bottom of each end of strap piece 15 are conventional snap connections 16 to which a chin strap 17 can attach to hold jaw protective garment 14 in place.

Attached to head piece 15 are flaps 18 similar in design to flaps 11, but shaped and positioned to cover the player's back jaw area.

Figure 8:
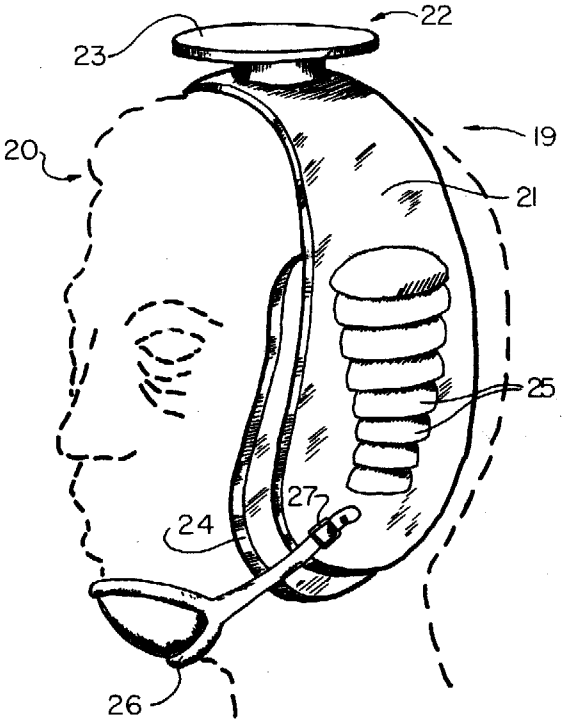
FIG. 8 is a three dimensional view of an alternate embodiment of the jaw protector of this invention.

Turning now to FIG. 8 an alternate preferred design of a jaw protector 19 is illustrated positioned on a player's head 20. In this embodiment the head piece comprises a flexible strip 21 that fits over head 20 and extends down either side of the face. In a preferred embodiment helmet web connector 22 is fixedly attached to strip 21 and is provided with a rubber button 23 that will attach to the football helmet webbing. In another preferred embodiment a pair of strips 24 constructed from foam or such similar material is attached to the inside of strip 21 so that each strip 24 extends over each side of the head as shown.

As before overlapping flap members 25 are attached to the outside surface of strip 21 at a position covering the back portion of the player's jaws. Finally, a conventional chin strap 26 is provided with snaps 27 to attach to strip 21.

There are, of course, many obvious modifications and other embodiments not specifically disclosed, but which are intended to be included within the scope of this invention as defined by the following claims.

What I claim is:

1. A jaw protective garment to be worn by a person to protect the jaw bones of said person comprising:

(a) a soft, flexible head piece shaped to fit over the top of the head of said person and extending down each side of said head a sufficient distance to cover the back portion of the said jaw bones;

(b) a chin strap attached to said head piece and shaped to fit snugly against the chin of said person to hold said piece in position; and (c) flap assemblies having overlapping, flexible convex flaps attached to said head piece and shaped to cover said back portion of said jaw bones for absorbing a blow thereto.

2. A jaw protective garment according to claim 1 wherein said flaps are hingedly attached to said head piece.

3. A jaw protective garment according to claim 1 wherein a helmet web connector is attached to said head piece, said connector having a button means attachable to the inside webbing of a football helmet.

4. A jaw protective garment according to claim 1 wherein a second set of strips is attached to the inside surface of said head piece and extend down each side of said head.

* * * * *